US005765272A

United States Patent [19]

Borcicky

[11] Patent Number: 5,765,272

[45] Date of Patent: Jun. 16, 1998

[54] PISTON RING COMPRESSOR

[75] Inventor: Richard D. Borcicky, Battleboro, N.C.

[73] Assignee: Cummins Engine Company, Inc., Columbus, Ind.

[21] Appl. No.: 511,892

[22] Filed: Aug. 7, 1995

[51] Int. Cl.[6] ..... B25B 1/04

[52] U.S. Cl. ..... 29/222; 269/131; 81/3.43; 81/64

[58] Field of Search ..... 29/222, 224, 223, 29/269, 229, 235, 243.56, 282; 269/287, 288, 131, 132; 81/3.43, 64

[56] References Cited

U.S. PATENT DOCUMENTS

| | | | |
|---|---|---|---|
| 1,103,717 | 7/1914 | Walton et al. . | |
| 1,148,472 | 7/1915 | Adams | 29/222 |
| 1,224,416 | 5/1917 | Rennau | 81/3.43 |
| 1,375,744 | 4/1921 | Watts . | |
| 1,444,072 | 1/1923 | Holland | 29/222 |
| 1,521,342 | 12/1924 | Thomas et al. | 81/3.43 |
| 1,618,480 | 2/1927 | Senn | 81/3.43 |
| 1,767,819 | 6/1930 | Solenberger | 29/222 |
| 1,811,248 | 6/1931 | Spencer | 29/222 |
| 1,910,729 | 5/1933 | Wheat . | |
| 2,012,200 | 8/1935 | Oberosler . | |
| 2,155,705 | 4/1939 | Gottwald | 269/288 |
| 2,607,092 | 8/1952 | Rubly | 29/222 |
| 2,655,719 | 10/1953 | Nelson . | |
| 2,846,968 | 8/1958 | Tipton | 269/287 |
| 2,855,252 | 10/1958 | Budinger et al. | 29/522.1 |
| 3,174,215 | 3/1965 | Huigens et al. | 29/222 |
| 3,374,526 | 3/1968 | Kyser . | |

FOREIGN PATENT DOCUMENTS

| | | | |
|---|---|---|---|
| 1809304 | 6/1970 | Germany . | |
| 153987 | 11/1920 | United Kingdom . | |
| 312019 | 5/1929 | United Kingdom . | |
| 551367 | 2/1944 | United Kingdom | 29/552.1 |

*Primary Examiner*—Robert C. Watson

*Attorney, Agent, or Firm*—Sixbey, Friedman, Leedom & Ferguson; Charles M. Leedom, Jr.; Jeffrey L. Costellia

[57] ABSTRACT

A ring compressor is provided including a resilient compression band for encircling, and applying a compression force to, the ring, and a band actuation device connected to the compression band for moving the compression band between a decompressed position in which the band ends are spaced and a compressed position in which the band ends are positioned in end to end, nonoverlapping abutment preventing further compression of the ring. The band actuation device may include an outer band encircling the resilient compression band and a hand operated lever assembly. The outer band provides radial support to the ends of the compression band to guide the first and second ends radially into abutment. A ring end axial alignment device may also be provided for guiding the ends of the compression band into axially aligned abutment when in the compressed position. In addition, the ring compressor of the present invention may include a replaceable insert ring which can be removably positioned concentrically within the compression band to permit the ring compressor to be used with piston assemblies of different sizes.

15 Claims, 4 Drawing Sheets

PISTON RING COMPRESSOR

TECHNICAL FIELD

The present invention relates, in general, to installing piston assemblies into corresponding cylinders, and more particularly, to a device used to compress piston rings around pistons for introduction into engine block cylinder bores.

BACKGROUND OF THE INVENTION

The introduction of a piston assembly into a cylinder bore of a combustion engine is a complex and awkward process wherein the piston rings must be compressed while the piston assembly is maintained properly oriented and positioned with respect to the engine block cylinder bore. This inherent awkwardness of the parts being handled is complicated by the necessity to compress the piston rings into grooves in the piston with a substantial degree of pressure creating handling problems for the operator installing the piston assembly.

Most conventional piston ring compressors are hand operated. For example, U.K. Patent No. 312,019 discloses a piston ring clamp which includes a two ring halves or stirrups connected together at one end by a hinge joint and connectable at opposite ends by a screw device. The stirrups are pivoted into an open position surrounding a piston having rings positioned thereon and moved to a closed position clamping and compressing the piston rings. The piston is then pushed through the clamp into the cylinder of an engine. An adjustable abutment member is provided between the separable ends of the stirrups to permit the closing of the two stirrups to be adjusted to a predetermined inside diameter to prevent the stirrups from engaging the outer surface of the piston thus ensuring the piston can be pushed out of the clamp into the cylinder. However, this clamping device applies compression forces on the piston rings which are not uniform along the circumference of the rings. This nonuniformity is caused by the pivotal clamping action of the stirrups which can create a "pinching" effect on portions of the rings, for example, adjacent the pivoting point of the clamp, causing greater compressive forces on those portions of the rings than the remaining portions of the rings. These nonuniform compression forces on the rings may cause undue stress in the rings possibly resulting in ring damage. Nonuniform compression forces on, or excessively high stress in, one area of the piston ring also hinders the ability of the piston to slide through the clamp into the cylinder thus requiring greater effort by the operator while also increasing the likelihood the ring will be damaged during sliding movement into the cylinder.

U.S. Pat. No. 2,012,200 to Oberosler discloses a piston ring compressor including two stirrups or semi-cylindrical members which are mounted on a common shaft. One of the members is moved toward the other to enclose and compress the rings. However, like the clamp disclosed in the '019 UK patent, the members tend to compress the rings in an uneven manner along the circumference of the rings. The amount of radial force exerted on a given set of rings by the members will be significantly affected by the inside diameter of the members especially since the members are relatively rigid. Unavoidable variations in the inside diameter of the members will cause variations in the radial force on the rings. Since the members must be very rigid and stiff to achieve the required radial force on the rings, the members are incapable of flexing to compensate for the variations thereby resulting in nonuniform radial forces on the rings. Consequently, it is possible that a portion of a ring or only one ring will be compressed sufficiently to permit insertion into the cylinder while a remaining portion or ring is not, potentially causing damage to the ring during insertion.

Another type of piston ring compressor, such as disclosed in U.S. Pat. No. 1,103,717 to Walton, uses an overlapping band to compress the rings. The two end sections of the band are attached via a pivotable lever which is moved to pull the end sections of the band together thus compressing the rings. However, during compression, one end of the band overlaps the opposite end. The outer end section thus compresses an inner end section and its associated end edge forcing the edge against the piston ring disadvantageously causing high stress in the ring at the point of contact by the inner band edge. Moreover, the inner band edge tends to catch on the ring and the outer band as the edge is compressed and slid between, and relative to, these surfaces disadvantageously resisting movement of the band into a closed, compressed position around the ring thus causing undue effort by the operator. Also, this overlapping band can easily be misused to overcompress the piston rings so that the band abuts the piston preventing the piston from being slid from the band into a cylinder. U.S. Pat. Nos. 1,375,744; 2,655,719; 3,374,526; and German publication 1809304 disclose other piston ring compressors including one or more bands which overlap and therefore experience the same problems discussed in relation to Walton.

U.S. Pat. No. 1,910,729 to Wheat discloses a piston ring applier which includes an outer split ring with overlapping ends and an inner band mounted on the inner surface of split ring to provide a smooth inner contact surface. However, the overlapping ends of the outer split ring still create localized areas of increased force which is transmitted through the inner band to the piston ring creating nonuniform loading on the ring. In addition, the inner band includes two end edges which are pressed radially inward against the piston ring by the outer split ring potentially damaging the ring during compression and/or sliding of the piston out of the applier. Also, this device provides no means for preventing inadvertent overcompression of a piston ring.

U.K. Patent No. 153,987 discloses a device for manipulating piston rings which includes a single circular band with handles formed at each end of the band. However, this device is not used to compress piston rings but only to insert and remove a piston ring from a piston by pulling the ends of the band apart to expand the piston ring from its normal relaxed state.

Therefore, there is a need for a simple, inexpensive piston ring compressor capable of accurately and effectively compressing rings a desired amount while both maintaining a substantially uniform radial compression force on the rings and minimizing the effort required for operation.

SUMMARY OF THE INVENTION

It is an object of the present invention, therefore to overcome the disadvantages of the prior art and to provide a piston ring compressor for effectively compressing piston rings.

It is another object of the present invention to provide a piston ring compressor capable of holding piston rings in a compressed state in such a manner so as to permit the piston and compressed rings to be discharged from the compressor in a smooth and reliable manner.

It is yet another object of the present invention to provide a piston ring compressor capable of applying uniform compression forces on the piston ring around its entire circumference.

It is a further object of the present invention to provide a piston ring compressor which minimizes the effort required by an operator in compressing the rings and inserting a piston assembly into an engine cylinder.

It is a still further object of the present invention to provide a piston ring compressor capable of ensuring that only an optimal amount of compressive forces applied to the piston rings thereby minimizing piston ring damage due to improper compressive forces.

Yet another object of the present invention is to provide a piston ring compressor assembly capable of compressing piston ring assemblies of many different sizes.

A further object of the present invention is to provide a piston ring compressor capable of ensuring that the ends of the compressive ring evenly abut to provide a smooth surface for subsequent movement of the piston ring.

Yet another object of the present invention is to provide a piston ring compressor capable of either being mounted on a support arm in a manufacturing assembly line or used as a separate tool for engine maintenance.

These and other objects are achieved by providing a ring compressor including a resilient compression band for encircling, and applying a compression force to, the ring, wherein the compression band includes a first end, a second end positioned adjacent the first end and a compression surface extending between the first and second ends. The ring compressor also includes a band actuation device connected to the compression band for moving the compression band between a decompressed position in which the first end is positioned a spaced distance from the second end and a compressed position in which the first end is positioned in end to end abutment with the second end to prevent further compression of the ring. In a compressed position, a continuous, circular compression surface extending between the first and second ends of the compression band compressively abuts the piston ring continuously to form a continuous, substantially circular line of compressive contact. In a compressed position, the first end of the compression band is positioned in an nonoverlapping relation immediately adjacent the second end. The band actuation device may also include an outer band encircling the resilient compression band and the outer band may be rigidly connected to the compression band. The band actuation device may also include a hand operated lever assembly which may include a first link pivotably connected to one end of the outer band, a handle extending from the first link, a connector pivotably connected to a second end of the outer band and a second link pivotably connected at one end of the connector and at an opposite end to the first link. The outer band provides radial support to the ends of the compression band during movement from the decompressed position to the compressed position so as to guide the first and second ends radially into abutment. The handle of the lever assembly is movable between an engaged position corresponding to the compressed position of the band and a disengaged position corresponding to the decompressed position of the compression band. The lever assembly may also include a biasing spring mounted on the connector for biasing the handle toward the disengaged position. A ring end alignment device may also be provided for guiding the ends of the compression band into abutment to ensure axial alignment when in the compressed position. The ring end alignment device may include a circumferential recess formed in one end of the compression band and a circumferential extension formed in the opposite end of the band for engaging the circumferential recess as the band is moved into the compressed position. In addition, the ring compressor of the present invention may include a replaceable insert ring which can be removably positioned concentrically within the compression band in abutment with the compression surface of the band to permit the ring compressor to be used with piston assemblies of different sizes.

DETAILED DESCRIPTION OF THE PREFERRED EMBODIMENT

The ring compressor of the present invention indicated generally at 10 includes a resilient circular compression band 12 surrounded by a band actuation device 14 used to move the compression band 12 between a compressed position and a decompressed position. Band actuation device 14 and compression band 12 operate in conjunction to apply uniform compression forces around the circumference of a piston ring thereby ensuring accurate and effective compression of the ring without risk of ring damage while also preventing overcompression.

Figure 1:
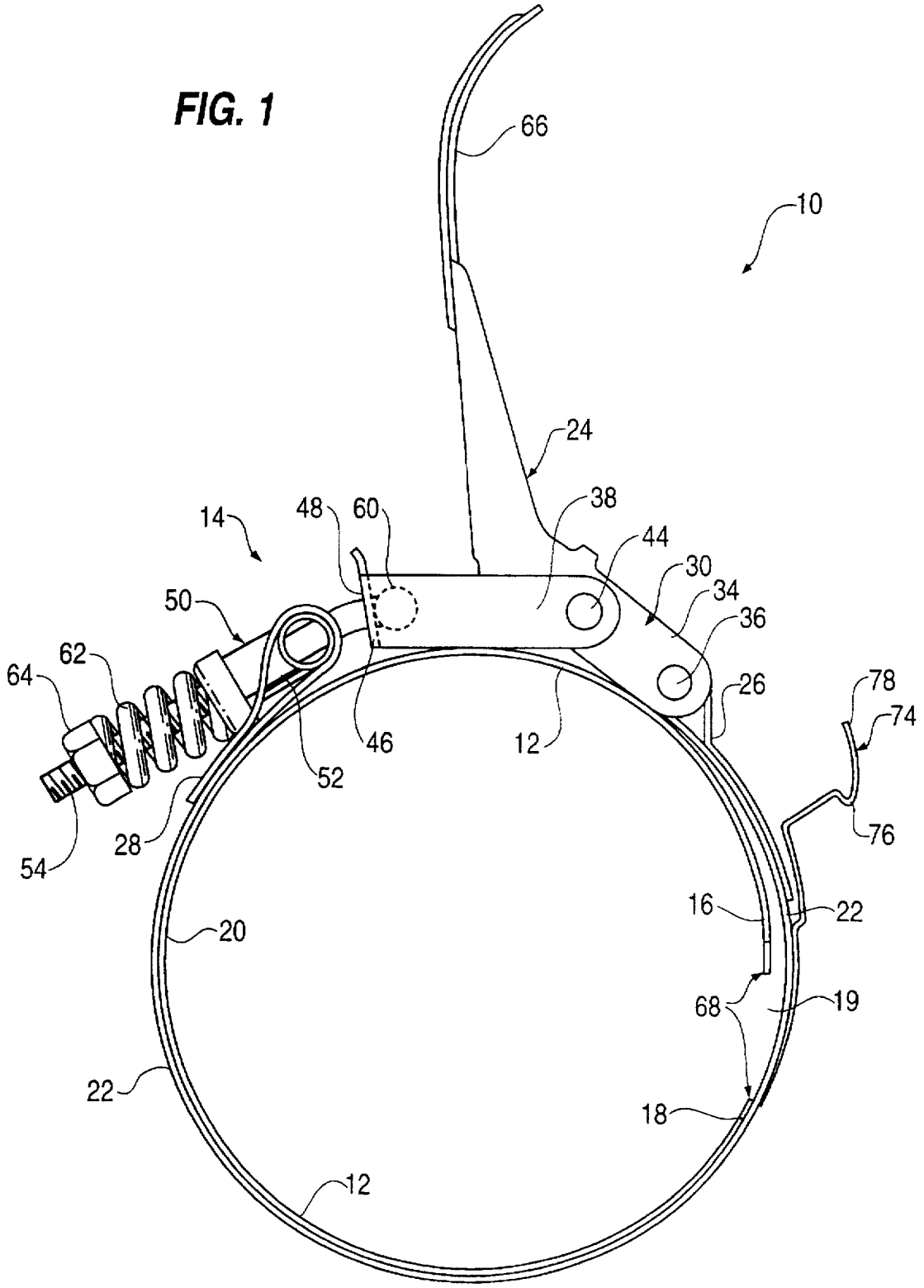
FIG. 1 is a front elevational view of the piston ring compressor of the present invention in a disengaged and decompressed position.
Figure 2:
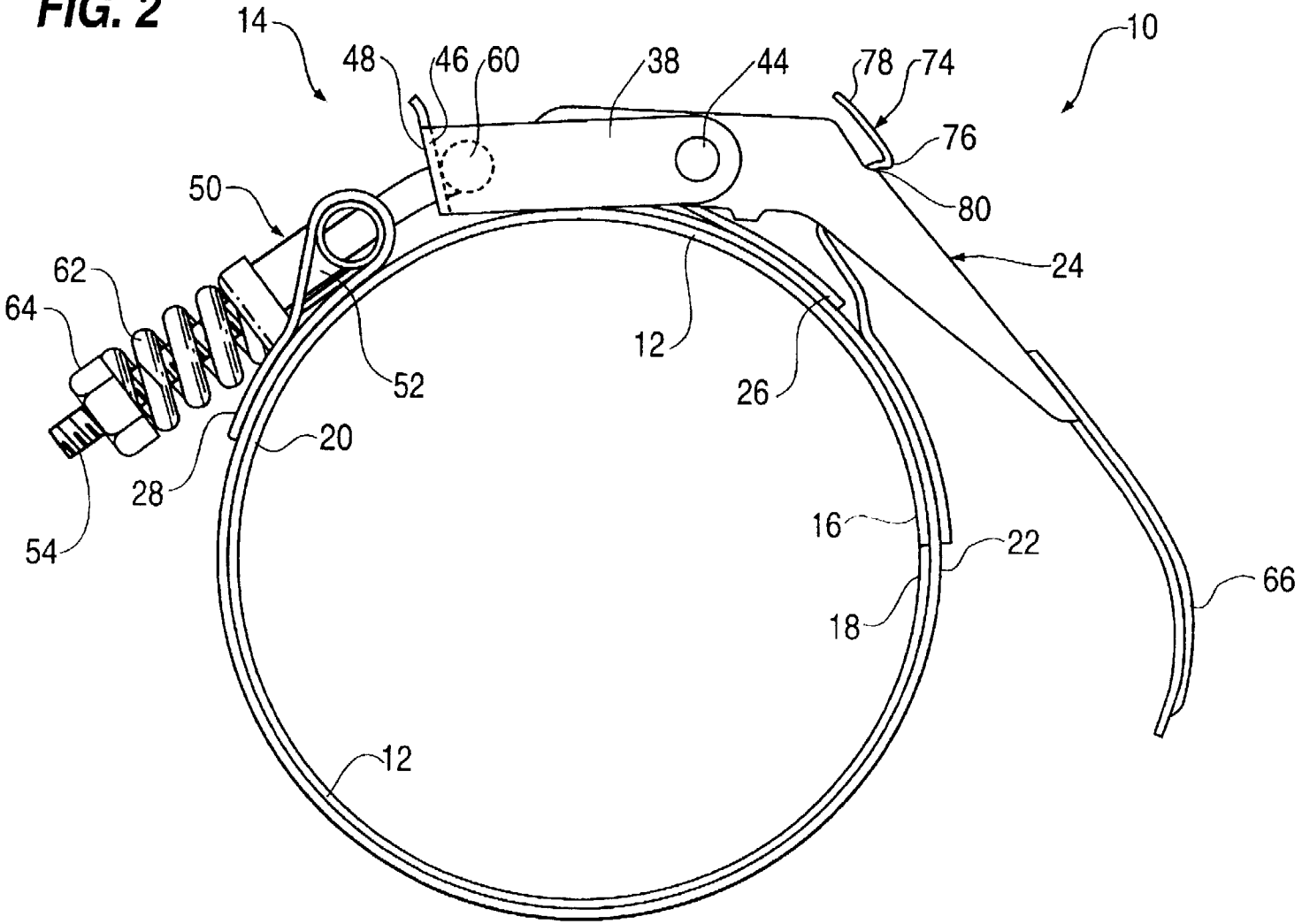
FIG. 2 is a front elevational view of the piston ring compressor of the present invention in an engaged and compressed position.

As shown in FIG. 1, compression band 12 is circular in shape and includes a first end 16 positioned a spaced distance from a second end 18 to form a gap 19 when compression band 12 is in a normally relaxed state corresponding to the decompressed position. Compression band 12 also includes an inner compression surface 20 extending continuously between first end 16 and second end 18 for contact with a piston ring during movement of compression band 12 into the compressed position as shown in FIG. 2. Compression band 12 is preferably formed with a band width adequate to cover the ring area of a piston to be inserted into a cylinder. In this manner, ring compressor 10 can be used to compress all of the piston rings simultaneously. Compression band 12 may be formed of any hard yet flexible and resilient material, such as stainless steel, capable of compressing piston rings without compression surface deformation while resiliently returning to the decompressed position. Inner compression surface 20 is preferably polished to provide a smooth finish for promoting sliding of the piston rings.

Figure 3:
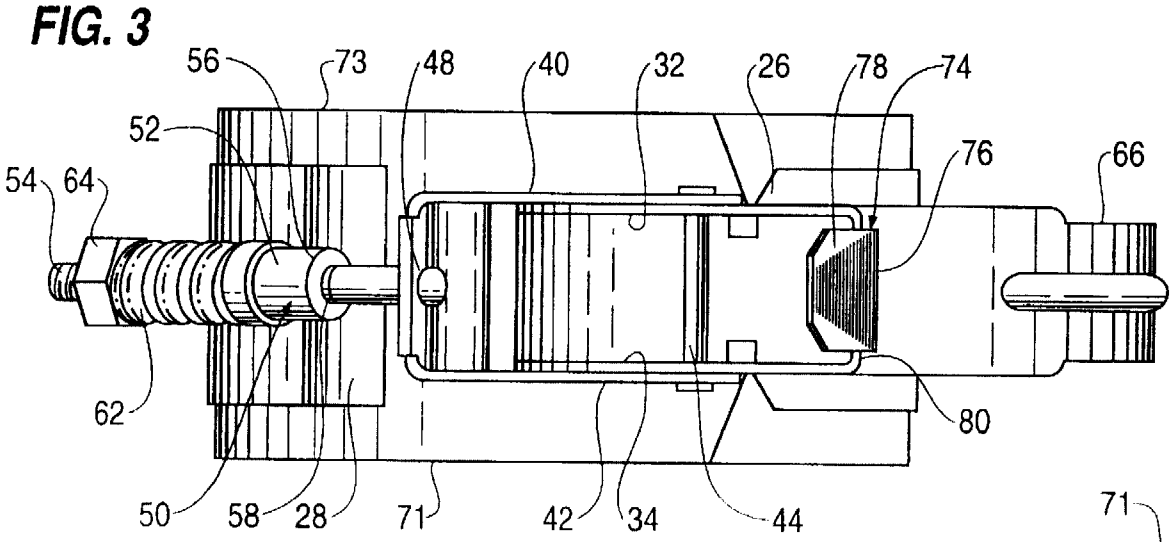
FIG. 3 is a side elevational view of the piston ring compressor of the present invention in the engaged and compressed position.

Band actuation device 14 includes an outer band 22 and a hand operated lever assembly 24. Outer band 22 encircles compression band 12 so as to extend across or span gap 19. A first end 26 and a second end 28 of outer band 22 are each connected to the hand operated lever assembly 24 to permit actuation of ring compressor 10 between compressed and decompressed position. Outer band 22 may also be formed of any resilient hard material, such as stainless steel, capable of maintaining its circular shape so as to support compression band 12. As shown in FIG. 3, outer band 22 may have a width less than that of compression band 12. Outer band 22 preferably extends around the entire circumference of compression band 12 to advantageously provide compressive support to compression band 12 and for ease of manufacturing. However, outer band 22 may alternately only include two separate band sections or ends, similar to ends 26, 28, without an interconnecting band portion, which are rigidly attached to compression band 12, so long as end section 26 extends across gap 19 to provide radial support and alignment to the compression band ends. Preferably, first and second ends 26, 28 of outer band 22 are rigidly attached to compression band 12 by, for example, welding.

Hand operated lever assembly 24 includes a first link 30 having two spaced, parallel arms 32, 34 connected to the first end 26 of outer band 22 by a pin 36. First end 26 wraps around pin 36 to provide a pivotal connection between first link 30 and first end 26. The end portion of first end 26 is attached to another portion of outer band 22 by, for example, welding. A second link 38 includes bars 40, 42 spaced apart so as to each extend along a respective arm 32, 34 of first link 30. The end of each bar 40, 42 is pivotally connected to first link 30 by a transverse pivot pin 44. The opposite end of second link 38 includes a transverse end wall 46 having a central aperture 48.

Band actuation device 14 also includes a connector device 50 for connecting second link 38 to second end 28 of outer band 22 thus completing the operably lever connection between first end 26 and second end 28 of outer band 22. Connector device 50 includes a t-shaped hollow anchor device 52 and a threaded bolt-like fastener 54 extending through the central leg of anchor device 52. Second end 28 of outer band 22 includes an opening 56 and second end 28 wraps around the transverse portion of t-shaped anchor device 52 so that the central portion of the anchor device 52 extends through opening 56. Fastener 54 extends through an aperture 58 formed in the top of anchor device 52 and through aperture 48 terminating in a t-shaped distal end 60 pivotally connecting fastener 54 to second link 38. A biasing spring 62 is mounted on the opposite end of fastener 54 and held in place by an adjustable nut 64 engaging complimentary threads formed on fastener 54.

Lever assembly 24 also includes an elongated handle 66 integrally formed on first link 30. Handle 66 provides the proper leverage necessary for an operator to easily manipulate lever assembly 24 by pivoting first link 30 about pin 36. Biasing spring 62 acts against nut 64 to bias fastener 54 and link 38 toward second end 28 thus tending to move first link 30 and handle 66 into a disengaged position as shown in FIG. 1. During movement of handle 66 to an engaged position as shown in FIG. 2 causing the compression band 12 to move into a compressed position, biasing spring 62 functions to resist, and therefore control, the movement of handle 66 toward the engaged position thereby preventing handle 66 from being quickly forced into the engaged position. As a result, biasing spring 62 tends to cause compression band 12 to move slowly into contact with a piston ring thereby preventing inadvertent, sudden slamming of handle 66 and compression band 12 against a piston ring possibly causing piston ring damage.

Figure 4:
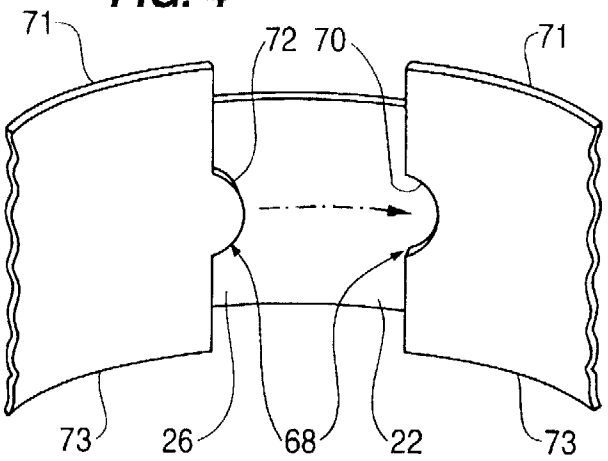
FIG. 4 is a cut away elevational view of a portion of the compression band including the ring end axial alignment device of the present invention.

Ring compressor 10 also includes a ring end axial alignment device 68 for ensuring that first end 16 and second end 18 of compression band 12 are aligned axially with reference to the central axis of compression band 12 once abutment of ends 16 and 18 occurs. Ring end alignment device 68 includes a circumferential recess 70 formed in second end 18 and a circumferential extension 72 formed on the edge of first end 16 opposite circumferential recess 70. As first and second end 16, 18 approach abutment, circumferential extension 72 enters circumferential recess 70. Extension 72 and recess 70 are formed with mating shapes or edges which engage in a complimentary manner to force first and second end 16, 18 into axial alignment. For example, as shown in FIG. 4, circumferential extension may be semi-circular and include an arcuate edge for abutment against the arcuate edge of a complimentary semi-circular recess 70. Ring end axial alignment device 78 thus ensures that outer peripheral edges 71, 73 of compression band 12 remain in axial alignment to permit the ring compressor 10 to be positioned flatly against a cylinder block for reliable movement of the piston into the engine cylinder.

Ring compressor 10 may also include a locking tab 74 rigidly attached to outer band 22 by, for example, welding, for securing handle 66 in the engaged position as shown in FIG. 2. Locking tab 74 includes a ridge 76 and tab portion 78 which extend through the opening between arm 32, 34 of first link 30. Ridge 76 is positioned relative to an inner edge 80 of handle 66 so that edge 80 must be forced over ridge 76 causing tab portion 78 and ridge 76 to flex thus permitting edge 80 to be moved over ridge 76. Ridge 76 then flexes back to its relaxed position locking handle 66 in the compressed position as shown in FIG. 2. Tab portion 78 can then be pushed to release handle 66.

During operation, with ring compressor 10 in the decompressed and disengaged position as shown in FIG. 1, compression band 12 and outer band 22 are placed over a piston containing piston rings so that compression surface 20 surrounds the piston ring or rings. Handle 66 is then gradually rotated around its pivot point at pin 36 causing first and second ends 26, 28 of outer band 22 to be pulled together. During this motion, pin 44 moves clockwise as shown in FIG. 1 around pin 36. As the first and second ends 26, 28 of outer band 22 are moved circumferentially toward one another by lever assembly 24, outer band 22 compresses compression band 12 forcing first end 16 and second end 18 toward one another. As first end 16 approaches second end 18, outer band 22 radially guides the bands into aligned abutment. Also, circumferential extension 72 engages circumferential recess 70 ensuring ends 16, 18 are in axial alignment. Once handle 66 has been moved into its fully engaged position, compression band 12 will be in a fully compressed stated with the distal edge of first end 16 in axial and radial aligned abutment with the distal edge of second end 18.

The inner diameter of compression band 12 of the present invention is designed with a predetermined optimum diameter while in the compressed state necessary to compress the piston rings of a given size piston an optimum amount without overcompressing the rings. Overcompression may cause compression surface 20 to contact the outer piston surface making it difficult or impossible for the piston assembly to be slidably removed from ring compressor 10 without damaging the piston and/or rings. Moreover, the piston rings need not be compressed to a diameter smaller than the inner diameter of the cylinder bore into which the piston will be slid. The resilient compression band 12 of the present invention is designed with an inner diameter equal or only slightly less than the diameter of the cylinder bore into which the piston and ring assembly will be mounted. As a result, the present ring compressor 10 prevents overcompression of the piston rings thereby minimizing piston ring damage and ensuring smooth movement of the piston rings over the joint created by placing compression band 12 against a cylinder block adjacent a cylinder bore. The compression band 12 in combination with the band actuation device 14 of the present invention also ensures that uniform compression forces are applied to the piston rings around the circumference of the rings. The action of lever assembly 24 in pulling the ends 26, 28 of outer band 22 toward one another functions as a tourniquet type of device useful in applying uniform radial forces to compression band 12 thereby avoiding the "pinching" effect of prior art clamping devices having two circular halves pressed together. Moreover, neither ends 16, 18 of compression band 12 nor the ends 26, 28 of outer band 22 overlap thereby avoiding the localized stress points caused by the edge of an overlapped band being pressed into the piston ring and/or the compression band. In addition, the present invention uses ring end axial alignment device 68 to provide axially aligned abutment between the compression band ends causing the peripheral edges 71, 73 of the compression band to be positioned in single respective planes. As a result, the compression ring can be positioned flatly against a housing to provide a continuous, gap-free joint between the peripheral edges and the housing thus ensuring smooth sliding of the piston assembly into the housing bore. Also, the outer band 22 provides radial support and alignment of ends 16, 18 to ensure a compression surface free of uneven joints between the ends of the compression band.

Figure 5:
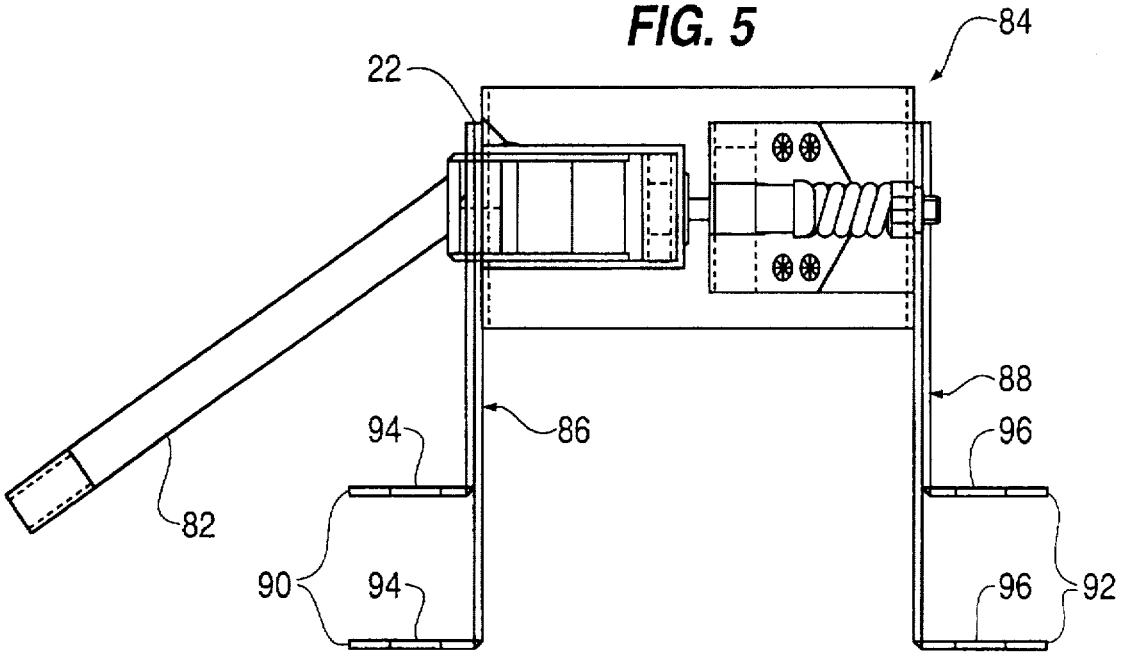
FIG. 5 is a side elevational view of a second embodiment of the piston ring compressor of the present invention.

Referring to FIG. 5, another embodiment of the ring compressor of the present invention is shown which is substantially the same as the embodiment illustrated in FIG. 1 except that a handle 82 extends at an acute angle relative to a transverse plane of the ring compressor 84. As a result, handle 82 extends outwardly away from the surface of the body containing the cylinder, i.e. an engine block or pump housing, toward the operator of ring compressor 84. In this manner, handle 82 will more likely clear protrusions extending from the block or housing permitting an operator to more easily grasp and operate the assembly. Also, ring compressor 84 includes support arms 86, 88 rigidly connected to outer band 22. Support arms 86, 88 are diametrically positioned on outer band 22 and extend axially to form two pairs of transverse flanges 90, 92. Support arms 86, 88 may be used to mount ring compressor 84 onto a movable support assembly (not shown) mounted adjacent an assembly line for manufacturing a product containing pistons. Flanges 90, 92 may include holes 94 for a receiving bolt (not shown) securely attaching the compressor to the movable support assembly.

Figure 6:
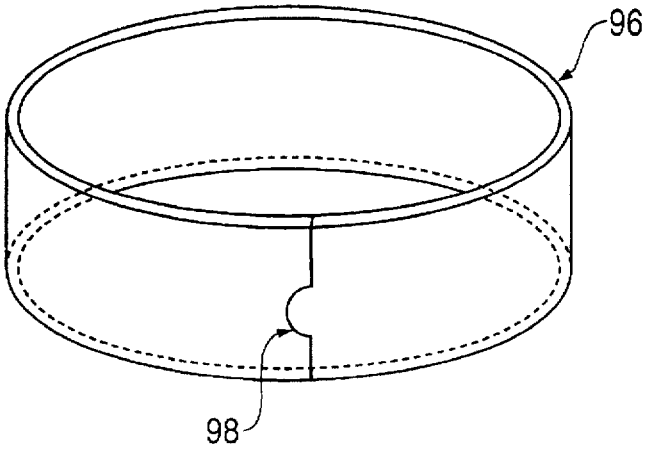
FIG. 6 is a perspective view of an insert ring used in conjunction with the piston ring compressor of the present invention.

The present invention also includes replaceable insert band 96 illustrated in FIG. 6 which can be positioned inside ring compressors 10 and 84 in concentric relation to compression band 12. Insert band 96 may be provided with a ring end axial alignment device 98 which is substantially the same as ring end axial alignment device 68. In this manner, an existing ring compressor 10, 84 designed with a compression band 12 having a predetermined compressed inner diameter, can be used to effectively compress rings of pistons having smaller diameters than that for which it was originally designed. The thickness of replaceable insert band 96 can be selected to achieve the desired compressed inner diameter desired. In this manner, the ring compressor of the present invention can be used on a variety of different sizes of pistons while maintaining the improved combination of benefits including optimal ring compression without overcompression, smooth, ergonomically enhanced operation between decompressed and compressed positions, the application of uniform compression forces around the circumference of the ring, creation of a smooth, uniform sliding surface for unrestrained sliding movement of the piston and axially aligned peripheral edges for minimizing undesirable gaps between the compressor and an abutting bore-containing housing.

INDUSTRIAL APPLICABILITY

This ring compressor of the present invention is useful in a variety of industrial and engineering applications requiring the compression of flexible rings for insertion into a corresponding cylinder, such as reciprocating air compressors and fluid pumps. However, a particularly desirable application of the invention is for assisting in the installation of piston assemblies into an engine block of an internal combustion engine.

I claim:

1. A ring compressor used for compressing a flexible ring for installation into a cylinder, comprising:

a resilient compression band for encircling, and applying a compression force to, the ring, said compression band including a first end, a second end positioned adjacent said first end and a compression surface extending between said first and second ends;

a band actuation means connected to said compression band for moving said compression band between a decompressed position in which said first end is positioned a spaced distance from said second end and a compressed position in which said first end is positioned in annular abutment with said second end to prevent further compression of the ring, said band actuation means further including a hand operated lever assembly which includes a handle; and a locking means for securing said compression band in said compressed position, said locking means including a flexible tab portion which automatically engages said handle in response to movement of said handle.

2. The ring compressor of claim 1, wherein said band actuation means includes an outer band extending along an outer peripheral surface of said resilient compression band and spanning said spaced distance between said first and second ends of said compression band when in said decompressed position, said outer band providing radial support to said first and second ends of said compression band during movement from said decompressed position to said compressed position so as to guide said first and second ends into radially aligned abutment.

3. The ring compressor of claim 2, wherein said outer band is rigidly connected to said compression band.

4. The ring compressor of claim 3, wherein said lever assembly includes a first link pivotally connected to a first end of said outer band, a handle extending from said first link, a connector pivotally connected to a second end of said outer band and a second link pivotally connected at one end to connector and at an opposite end to said first link.

5. The ring compressor of claim 4, wherein said handle is movable between an engaged position corresponding to said compressed position of said compression band and a disengaged position corresponding to said decompressed position, said lever assembly further including a biasing spring mounted on said connector for biasing said handle toward said disengaged position.

6. The ring compressor of claim 1, further including a ring end axial alignment means for ensuring that said first end of said compression band is positioned in axial alignment with said second end when said compression band is in said compressed position.

7. The ring compressor of claim 6, wherein said ring end axial alignment means includes circumferential recess formed in said first end and a circumferential extension formed in second end for engaging said circumferential recess as said compression band is moved into said compressed position.

8. The ring compressor of claim 1, further including a replaceable insert ring removably positioned in abutment with said compression surface of said compression band.

9. A ring compressor used for compressing a flexible ring for installation into a cylinder, comprising:

a resilient, circular compression band for encircling, and applying a compression force to, the ring, said compression band including a first end, a second end positioned a spaced angular distance along said circular compression band from said first end and a continuous, circular compression surface extending between said first and second ends for compressing the ring;

a band actuation means connected to said compression band for moving said compression band between a decompressed position in which said first end is positioned a first spaced distance from said second end and a compressed position in which said first end is positioned in a nonoverlapping relation immediately adjacent said second end, wherein said continuous, circular compression surface compressively abuts the ring continuously when in said compressed position to form a continuous, substantially circular line of compressive contact, wherein said band actuation means includes an outer band encircling said resilient compression band and a hand operated lever assembly, said hand operated lever assembly including a handle for movement between an engaged position corresponding to said compressed position of said compression band and a disengaged position corresponding to said decompressed position; and a locking means for securing said handle in said engaged position, said locking means including a flexible tab portion which automatically engages said handle in response to movement of said handle.

10. The ring compressor of claim 9, wherein said outer band is rigidly connected to said compression band, wherein said lever assembly includes a first link pivotally connected to a first end of said outer band, a handle extending from said first link, a connector pivotally connected to a second end of said outer band and a second link pivotally connected at one end to connector and at an opposite end to said first link.

11. The ring compressor of claim 9, wherein said outer band provides radial support to said first and second ends of said compression band during movement from said decompressed position to said compressed position so as to guide said first and second ends radially into abutment.

12. The ring compressor of claim 9, further including a ring end axial alignment means for ensuring that said first end of said compression band is positioned in axial alignment with said second end when said compression band is in said compressed position, wherein said ring end axial alignment means includes circumferential recess formed in said first end and a circumferential extension formed in second end for engaging said circumferential recess as said compression band is moved into said compressed position.

13. The ring compressor of claim 9, further including a replaceable insert band removably positioned in abutment with said compression surface of said compression band.

14. The ring compressor of claim 6, wherein said first end includes an arcuate edge defining at least a portion of said circumferential recess, said circumferential extension including an arcuate extension edge for complimentary engagement with said arcuate edge of said first end.

15. The ring compressor of claim 14, further including a replaceable insert band removably positioned in abutment with said compression surface of said compression band.

* * * * *